United States Patent [19]

Sasaki et al.

[11] Patent Number: 4,647,178

[45] Date of Patent: Mar. 3, 1987

[54] UNIT-TYPE COPYING MACHINE

[75] Inventors: Kouichi Sasaki, Osaka; Hideaki Tsudaka, Neyagawa; Satoshi Namba, Okayama; Yuji Abe, Hirakata; Shinsuke Yoshinaga, Kitakyushu, all of Japan

[73] Assignee: Mita Industrial Co., Ltd., Osaka, Japan

[21] Appl. No.: 693,945

[22] Filed: Jan. 23, 1985

[30] Foreign Application Priority Data

Feb. 7, 1984 [JP] Japan ..... 59-21210

[51] Int. Cl.[4] ..... G03G 15/00

[52] U.S. Cl. ..... 355/3R; 355/8; 355/11

[58] Field of Search ..... 355/3 R, 3 DR, 3 BE, 355/8, 11

[56] References Cited

U.S. PATENT DOCUMENTS 4,490,033 12/1984 Gage et al. ..... 355/3 R X 4,500,195 2/1985 Hosono ..... 355/3 R

FOREIGN PATENT DOCUMENTS 57-4074 6/1980 Japan .

*Primary Examiner*—A. C. Prescott

*Attorney, Agent, or Firm*—Jordan and Hamburg

[57] ABSTRACT

A unit-type copying machine comprising an upper unit having an optical system for exposing a document to light by scanning, and a lower unit provided independently of the upper unit and having a photoconductive drum to be exposed to an image of the document projected thereon from the optical system. The upper and lower units are provided with connecting portions for detachably connecting the two units together and positioning portions for positioning the optical path of projection of the document image from the optical system in coincidence with an exposure station for the drum. The upper or lower unit is usable with selected one of different types of lower units or of different types of upper units in a suitable combination.

8 Claims, 6 Drawing Figures

UNIT-TYPE COPYING MACHINE

BACKGROUND OF THE INVENTION

1. Field of the Invention

The present invention relates to improvements in transfer copying machines comprising an optical system for exposing an original to light by scanning and a photoconductive drum to be exposed to the image of the original projected thereon from the optical system.

2. Brief Description of the Prior Art

Such copying machines include those specifically designed for making life-size copies and those of the magnification variable type for producing reduced copies or for producing both enlarged and reduced copies. Further these copying machines incorporate various types of optical systems such as exposure lamp movable type and document carriage movable type. Conventionally, these different types of copying machines are fabricated individually each independently of another. Accordingly, various types must be manufactured each in a small quantity, hence the problem of high manufacturing cost occurs.

Also available are copying machines the main body of which is divided into an upper unit having an optical system for scanning originals and a lower unit having a developing device, transfer device, etc. Some of copying machines of this type are so designed that the upper unit is openable relative to the lower unit about a pivot provided at one end of the main body to facilitate replacement of interior components. Even in the case of such copying machines, the combination of upper and lower units of particular construction is manufactured for a specified type, so that the same problem as above is encountered.

SUMMARY OF THE INVENTION

A first object of the present invention is to overcome the foregoing problem and to provide a unit-type copying machine divided into an upper unit and a lower unit which are suitably selected in combination so that various types of copying machines can be manufactured inexpensively in accordance with the demand of users.

A second object of the present invention is to provide a unit-type copying machine wherein upper units having various types of optical systems are suitably selectively usable in combination with a common lower unit. Stated more specifically, in the case where the position of a photoconductive drum in the lower unit is predetermined, the positions of mirrors and other components of the optical system in the upper unit can be determined when the horizontal distance of the lens of the optical system from position determining means for the upper and lower units is determined, or the positions of the lens and other components of the optical system can be determined when the angle between the angle of incidence on the terminal mirror of the optical system and the angle of reflection therefrom is determined. Thus, various types of upper units are selectively usable for one lower unit provided that the upper units are so designed as to fulfil these requirements.

A third object of the present invention is to provide a unit-type copying machine wherein various lower units are suitably selectively usable in combination with a common upper unit. More specifically, the position of the photoconductive drum to be set is determined in accordance with the angle between the above angle of incidence and the above angle of reflection in the upper unit and with the lenth of optical axis between the terminal mirror and the drum, so that various types of lower units, if designed to fulfil these requirements, are selectively usable for one upper unit.

A fourth object of the invention is to provide a unit-type copying machine of the above structure wherein the upper and lower units can be connected together easily without necessitating any complicated adjusting procedure.

DETAILED DESCRIPTION OF THE INVENTION

The unit-type copying machine of the present invention comprises an upper unit including a document support for holding a document thereon and an optical system for exposing the document to light by scanning and a lower unit independent of the upper unit and including a photoconductive drum, devices arranged around the drum and a copy paper transport assembly, the upper and lower units being provided therebetween with connecting means for detachably connecting the two units together and with positioning means for positioning an optical path of projection of document images from the optical system in coincidence with an exposure station for the photoconductive drum.

Figure 1:
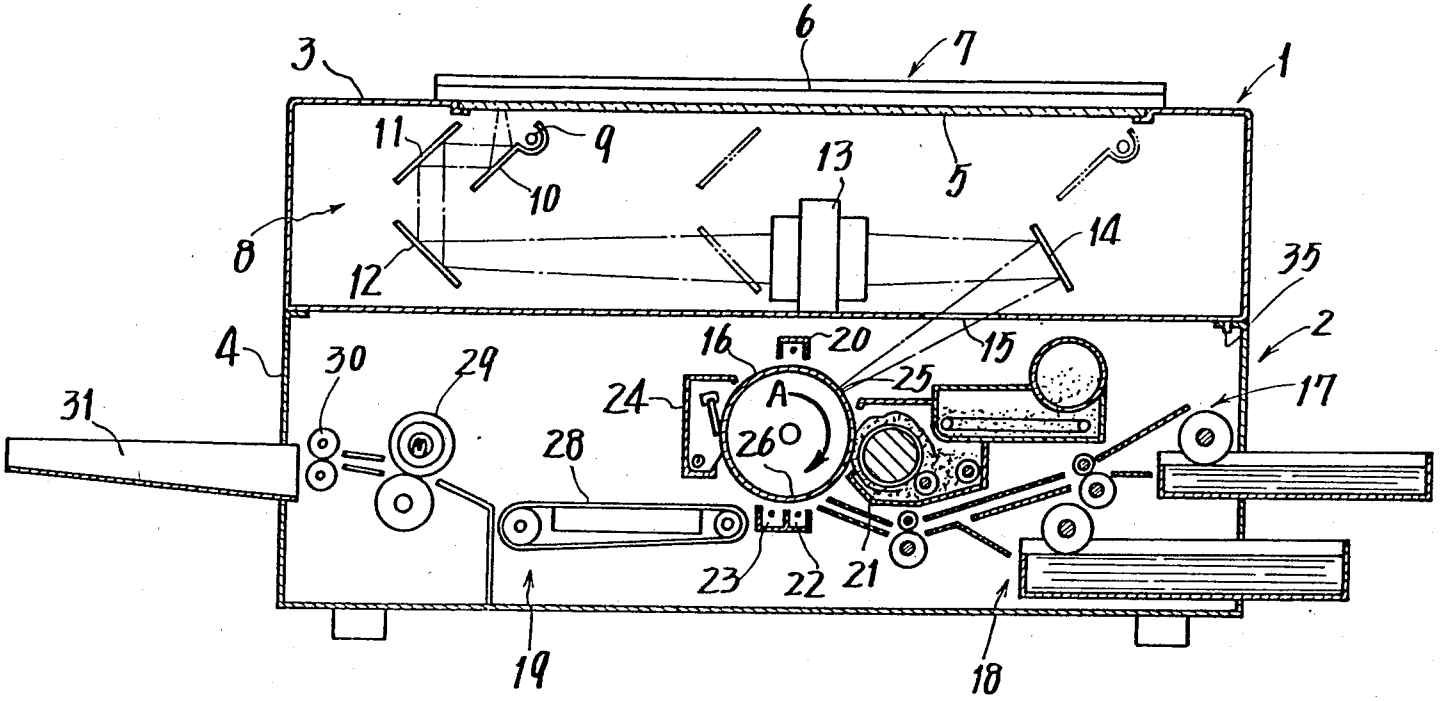
FIG. 1 is a sectional view showing a unit-type copying machine embodying the present invention.

FIG. 1 is a sectional view showing an embodiment of unit-type copying machine of the present invention. With reference to this drawing, indicated at 1 is an upper unit, and at 2 a lower unit. The upper and lower units 1, 2 are respectively provided with housings 3, 4 which are independent of each other. Provided at the upper side of the housing 3 of the upper unit 1 is a document support 7 comprising a glass plate 5 for placing thereon the document to be copied, and a document cover 6 for covering the document. The housing 3 has accommodated therein an optical system 8 designed specifically for life-size (1X) copying and adapted to expose the document on the glass plate 5 to light by scanning. The optical system 8 comprises an exposure lamp 9 disposed under the glass plate 5 horizontally movably for illuminating the document, and first to third mirrors 10, 11, 12, a lens 13 and a fourth (terminal) mirror 14 for directing the light reflected from the document toward an opening 15 formed in the bottom of the housing 3. Through the opening, the light is projected onto a photoconductive drum 16 within the lower unit 2. The exposure lamp 9 and the first mirror 10 are reciprocatingly movable below the glass plate 5 therealong by drive means (not shown). During the forward travel, the exposure lamp 9 goes on to optically scan the document. With this movement, the second and third mirrors 11, 12 reciprocatingly move at ½ of the velocity of the exposure lamp 9.

The housing 4 of the lower unit 2 has accommodated therein the photoconductive drum 16, devices arranged around the drum, paper feeders 17, 18 and a copy paper transport assembly comprising a paper discharge device 19, etc. The drum 16 is rotated in the direction of arrow A by drive means. The above-mentioned devices arrange around the drum 16 include a sensitizing corona charger 20, a developing device 21, a transfer corona charger 22, a separating corona charger 23 and a cleaner 24. With the rotation of the photoconductive drum 16, the surface of the drum 16 is uniformly charged by the sensitizing corona charger 20 and thereafter exposed at an exposure station 25 to the image of document projected thereon from the optical system 8, whereby an electrostatic latent image is formed on the drum surface. The latent image is developed to a toner image (visible image) by the developing device 21. At a transfer station, the toner image is transferred by the corona charger 22 to copy paper brought into contact with the drum surface. The image bearing paper is thereafter separated from the drum surface by the separating corona charger 23. The drum 16 further rotates, permitting the cleaner 24 to remove the residual toner particles from the drum 16. The copy paper is fed to the transfer station 26 from the paper feeder 17 or 18 and then sent forward onto a tray 31 by the paper discharge device 19 comprising a conveyor 28, fixing rollers 29, delivery rollers 30 and the like.

The lower unit 2 is usable not only for the optical system of the above life-size copying type but also for optical systems of other types.

Figure 2:
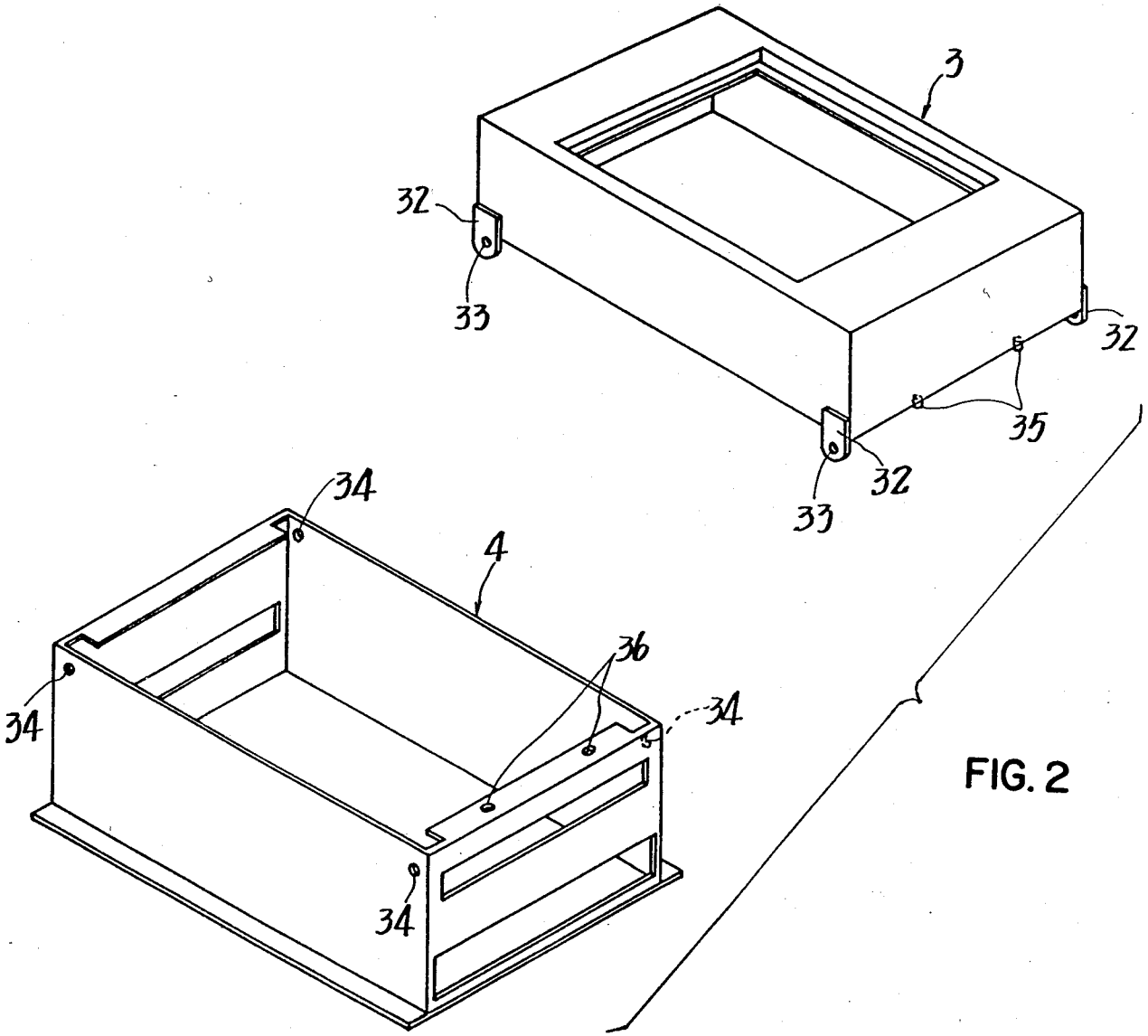
FIG. 2 is a perspective view showing examples of connecting means and positioning means for upper and lower units.

As seen in FIG. 2, connecting lugs 32 are attached to the four corners of the upper unit housing 3 at its lower end. The lugs 32 and the upper end four corners of the lower unit housing 4 are respectively formed with connecting holes 33, 34 in corresponding relation. The two housings 3, 4 are detachably connected to each other by connecting pins, bolts or the like through the holes 33, 34. The opposed faces of the housings 3, 4 to be joined together are provided with positioning means comprising projections 35 and engaging holes 36 in mating relation, whereby the two units 1 and 2 can be connected together with the path of projection of light from the optical system 8 coinciding with the exposure station 25 of the drum 16.

More specifically, the positioning means is provided to position the optical system 8 and the drum 16 in corresponding relation to each other so that the light reflected from the fourth mirror 14 can be projected on the drum 16 precisely at the exposure station 25 for forming a latent image of the document.

Determination of the correlation of the positioning means with the optical system 8 as well as with the drum 16 will be described below with reference to FIG. 3.

Suppose the distance from the document to the principal point R of the lens 13 via the first to third mirrors 10 to 12 along the optical axis is a, the distance from the principal point R of the lens 13 to the exposure station 25 for the drum 16 via the fourth mirror 14 along the optical axis is b, and the focal distance of the lens 13 is f. When there is the relation of $1/a+1/b=1/f$, an image of the document having a magnification of b/a is formed at the exposure station 25. Since the optical axis distance a and the focal distance f are predetermined for the upper unit 1 according to the type, the optical distance b needs to be determined based on the predetermined values.

Figure 3:
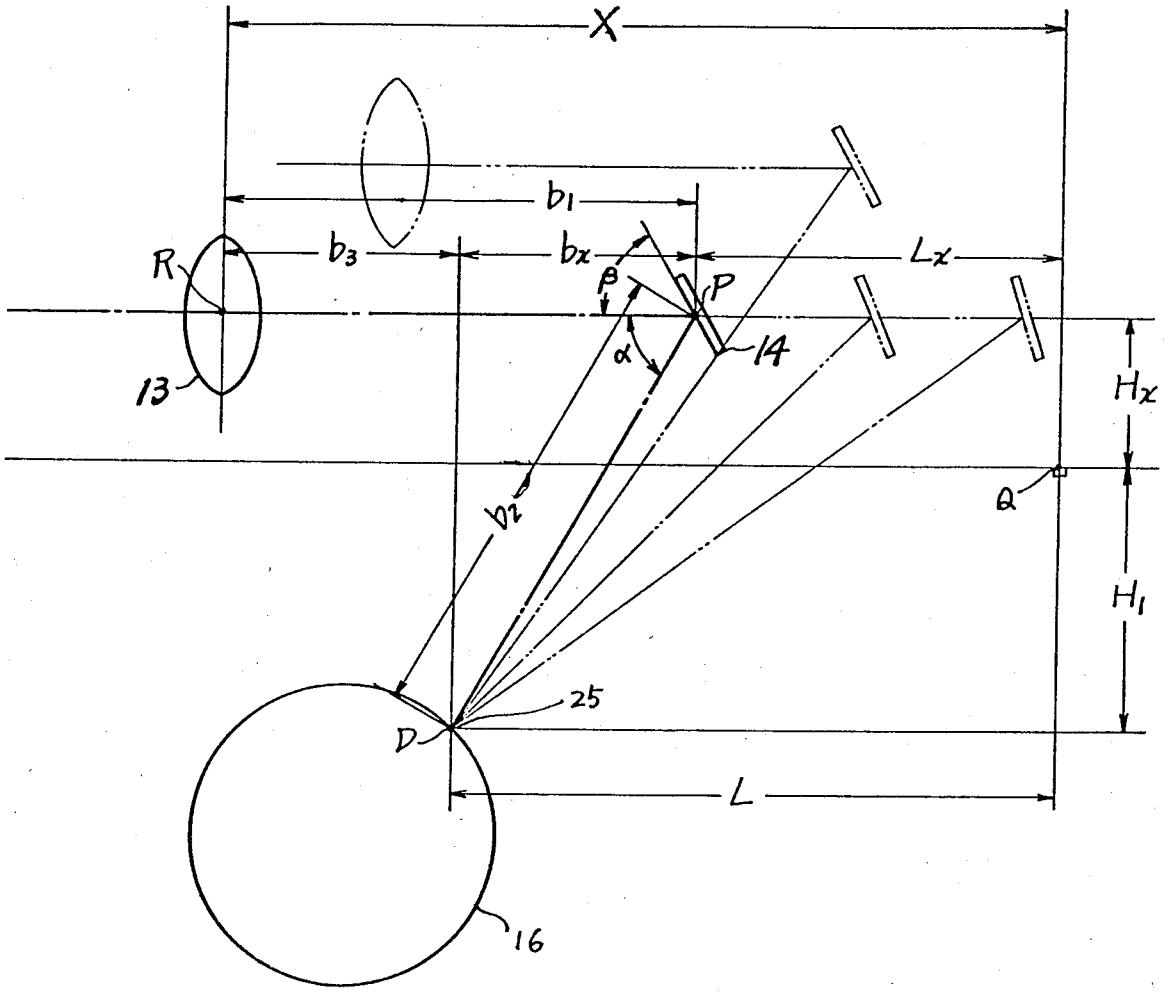
FIG. 3 and FIG. 4 are diagrams each illustrating the position relationship between an optical system and a photoconductive drum.

As shown in FIG. 3, the optical axis distance b is the sum of the optical axis distance $b_1$ from the principal point R of the lens 13 to a point P on the fourth mirror 14 and the optical axis distance $b_2$ from the point P to the image forming position D at the exposure station 25 for the drum 16. The optical system involves the following relations.

$$b=b_1+b_2 \tag{1}$$

$$b_1=b_3+b_x \tag{2}$$

$$b=b_3+b_x+b_2 \tag{3}$$

$$L_x=L-b_x \tag{4}$$

$$(H_1+H_x)^2+b_x^2=b_2^2 \tag{5}$$

In FIG. 3, the symbols represent the following.

P: Point of intersection of optical axis of lens 13 with fourth mirror 14

R: Principal point of lens 13

Q: Reference point of positioning means

L: Horizontal distance between point D and point Q $H_1$: Vertical distance between point D and point Q $H_x$: Vertical distance between point P and point Q $L_x$: Horizontal distance between point Q and point P $b_3$: Horizontal optical axis distance between point R and point D $b_x$: Horizontal optical axis distance between point D and point P X: Horizontal distance between point Q and point R $\alpha$: Angle optical axis makes with itself at point P $\beta$: Angle optical axis through principal point R and point P forms with fourth mirror 14

From Eq. (3) we obtain $b_2=b-b_3-b_x$. Substitution of this equation in Eq. (5) gives the following equation.

$$(H_1 + H_x)^2 + b_x^2 = (b - b_3 - b_x)^2 \tag{6}$$

$$\therefore b_x = \frac{(b - b_3)^2 - (H_1 + H_x)^2}{2(b - b_3)} \tag{7}$$

The vertical distance $H_1$ is predetermined for the lower unit 2, and the vertical distance $H_x$ is predetermined for the upper unit 1 according to the size of the lens 13. The horizontal optical axis distance $b_3$ is the difference between the horizontal distance X from the principal point R of the lens 13 to the point Q and the horizontal distance L and is expressed by $b_3=X-L$. Accordingly, if the horizontal distance X is predetermined, the horizontal optical axis distance $b_3$ is determined, and the horizontal optical axis distance $b_x$ can be determined from Eq. (7). When the distance $b_x$ is determined, Eq. (4), i.e. $L_x=L-b_x$, gives the horizontal distance $L_x$ as expressed below. Thus, the position of the fourth mirror 14 to be set is determined with respect to the reference point Q of the positioning means.

$$L_x = L - \frac{(b - b_3)^2 - (H_1 + H_x)^2}{2(b - b_3)} \tag{8}$$

Further Eq. (2), $b_1=b_3+b_x$, gives the optical axis distance $b_1$, based on which the optical axis distance $b_2$ can be determined from Eq. (1), $b=b_1+b_2$. As a result, the angles $\alpha$ and $\beta$ are given by the following equations.

Thus the angle $\beta$ of the fourth mirror 14 to be set is determined.

$$\cos \alpha = b_x/b_2 \quad (9)$$

$$\alpha = \cos^{-1}(b_x/b_2) \quad (10)$$

$$\beta = 90 - \alpha/2 \quad (11)$$

When the upper unit 1 is assembled based on the correlation between the positioning means and the optical system 8 of the upper unit 1 thus established according to the predetermined horizontal distance X, the path of projection of the light from the optical system 8 can be positioned in accurate coincidence with the exposure station 25 for the drum 16 merely by connecting the upper and lower units 1, 2 together as set in position by the positioning means.

Figure 4:
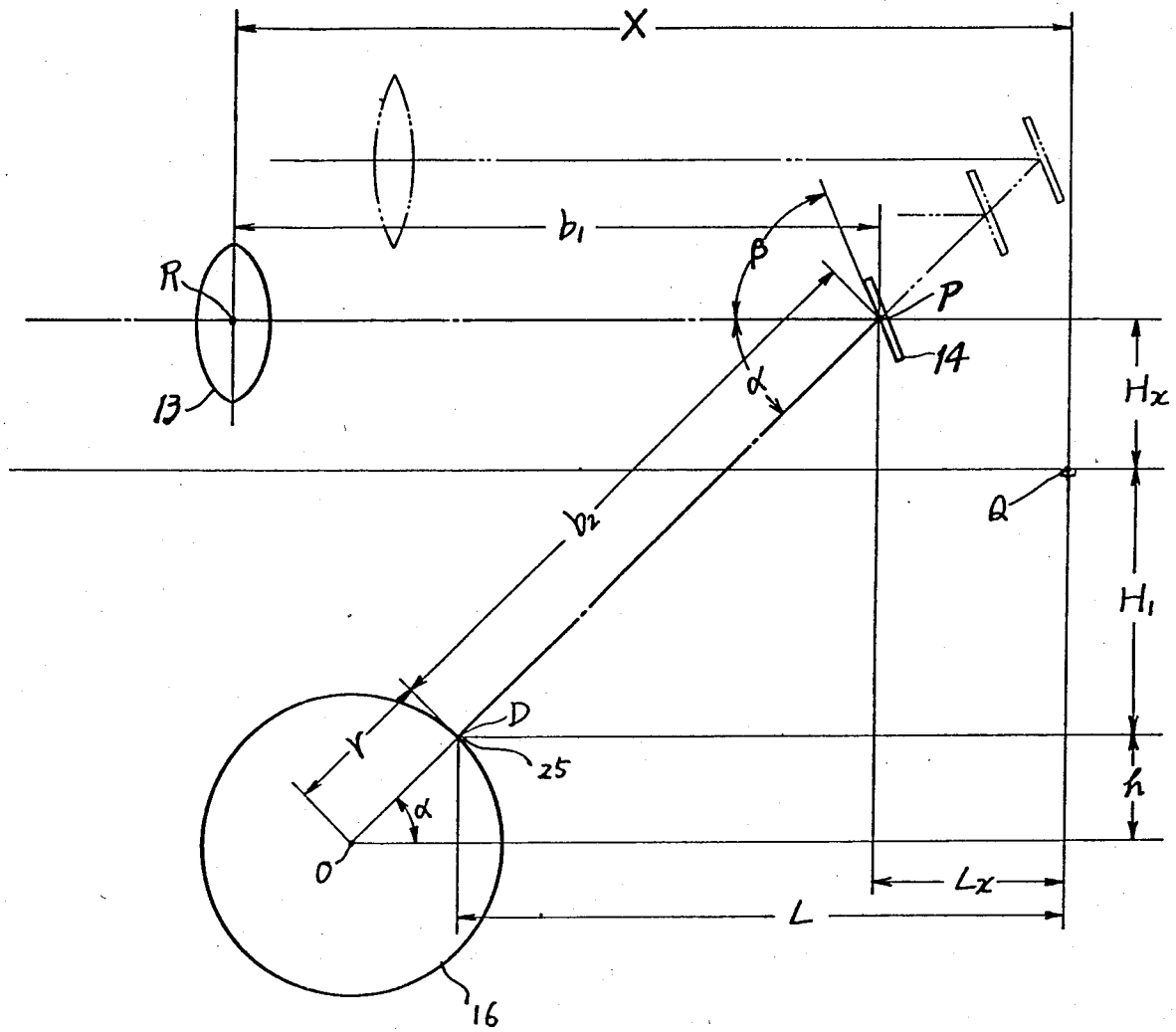

In order to form a copy image by properly projecting the image of document on the surface of the photoconductive drum 16, the position and angle $\beta$ of the fourth mirror 14 must be so determined that the center point O of the drum 16 is positioned on an extension of optical axis of reflected light from the fourth mirror 14 as shown in FIG. 4. The mirror position, although settable also by the foregoing method, can be determined more easily from the following equations. Suppose the drum 16 has a radium r, and the vertical distance between the image forming position D on the drum and the center point O of the drum is h. The angle $\alpha$ between the incident light on the mirror and the reflected light therefrom is given by $$\sin \alpha = h/r$$

$$\therefore \alpha = \sin^{-1}(h/r)$$

When the angle $\alpha$ is determined, the positions of the lens 13 and the fourth mirror 14 are given based on the equations below.

$$\tan \alpha = \frac{H_1 + H_x}{L - L_x} \quad (12)$$

$$\therefore L_x = L - \frac{H_1 + H_x}{\tan \alpha} \quad (13)$$

$$\sin \alpha = \frac{H_1 + H_x}{b_2} \quad (14)$$

$$\therefore b_2 = \frac{H_1 + H_x}{\sin \alpha} \quad (15)$$

Thus, Eq. (13) gives the horizontal distance $L_x$, which determines the position of the fourth mirror 14 with respect to the reference point Q. Since Eq. (15) gives the optical axis distance $b_2$, the horizontal distance X can be calculated from the following equation to determine the position of the lens 13 with respect to the reference point Q.

$$X = b_1 + L_x = b - b_2 + L - \frac{H_1 + H_x}{\tan \alpha} \quad (16)$$

In this way, the path for the reflected light from the optical system 8 can be positioned accurately in coincidence with the exposure station 25 for the drum 16 also by predetermining the angle $\alpha$ and establishing the correlation between the optical system 8 and the positioning means based on the angle.

Figure 5:
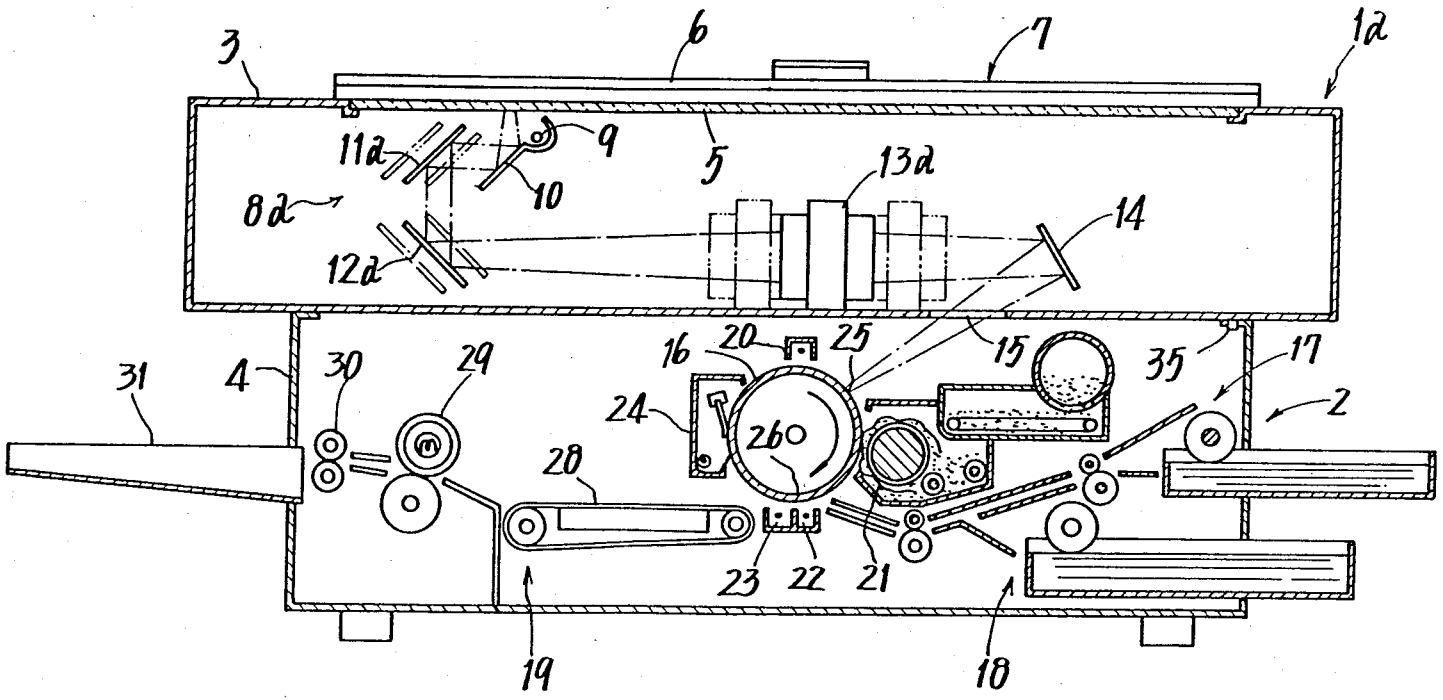
FIG. 5 and FIG. 6 are sectional views showing modes of using the unit-type copying machine of the invention wherein different types of upper units are selectively used for the same lower unit.
Figure 6:
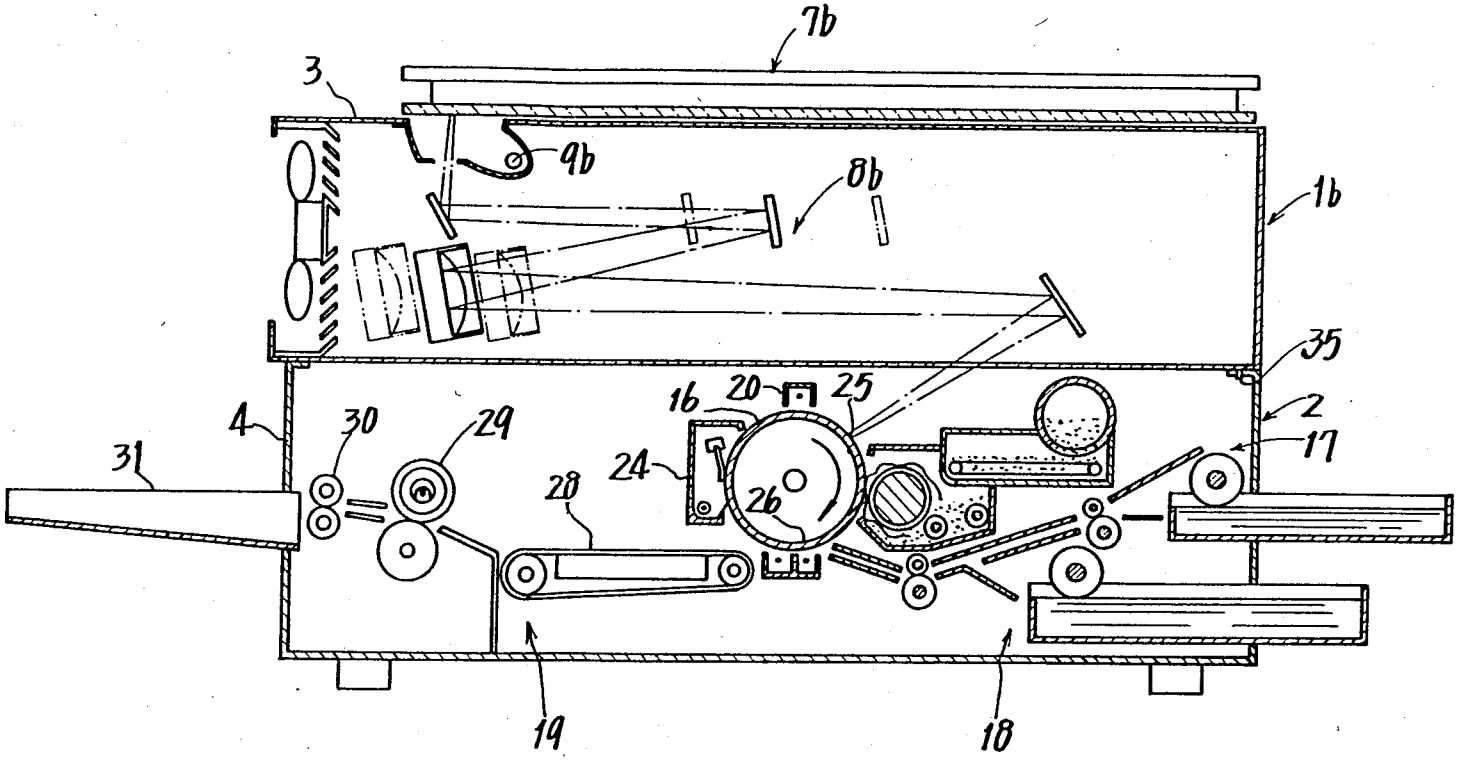

With the unit-type copying machine of the above construction, the upper unit 1 having the document support 7 and the optical system 8 is formed independently of the lower unit 2 which has the main components of the copying machine such as the drum 16, devices arranged therearound and paper transport assembly, while the lower unit 2 is usable commonly for different types of optical systems 8. Accordingly, one of upper units 1 equipped with various types of optical systems 8 is suitably selected for connection to the common lower unit 2. For example, a copying machine of the magnification variable type can be assembled by connecting the lower unit 2 to an upper unit 1*a* equipped with an optical system 8*a* in which a lens 13*a* and second and third mirrors 11*a*, 12*a* are movable and which has a reducing function and enlarging function as shown in FIG. 5, in place of the upper unit 1 having the optical system 8 for giving a magnification of 1X. Furthermore, it is possible to assemble a copying machine of the document support movable type by connecting the lower unit 2 to an upper unit 1*b* having an optical system 8*b* wherein an exposure lamp 9*b* etc. are stationary, and a document support 7*b* is movable for scanning as shown in FIG. 6. A thin-type copying machine can be provided by connecting the lower unit 2 to an upper unit equipped with a simplified optical system which has light transmitting means such as an optial fiber or a bundle of optical fibers.

Thus, different types of copying machines having various functions can be assembled with use of the common lower unit, so that the lower unit 2 having principal components of the copying machine can be standardized for mass production, whereby copying machines can be manufactured at a reduced cost. Moreover, a new type of copying machine is made available for the user at a low cost merely by replacing the upper unit 1 for use with the existing lower unit 2.

Furthermore, the upper unit 1 can be accurately positioned on the lower unit 2 by the positioning means comprising the projections 35 and the engaging holes 36 for the connection of the two units. This simplifies the assembling procedure, eliminating a cumbersome unit connecting procedure which requires fine adjustment for positioning the path of projection of the light from the optial system 8 in coincidence with the drum exposure station 25.

It is also possible to use the upper unit 1 in common for various lower units which differ in the diameter of the photoconductive drum 16 or in the number of paper feeders and which are suitably selectable. In this case, the horizontal position and level of the drum 16 to be installed in the lower unit 2 are determined with respect to the positioning means, according to the angle $\alpha$ between the incident light on the fourth mirror 14 and the reflected light therefrom and the optical axis distance b.

The drive means including a drive motor, drive circuit, etc. for the optical system 8 may be accommodated in the upper unit 1. Alternatively, the drive means may be accommodated in the lower unit 2 and made connectable to the optical system 8 when the upper and lower units 1, 2 are connected together.

The connecting means and the positioning means for the upper and lower units 1, 2 are not limited to those of the foregoing embodiment but can be modified variously. For example, the connecting means may comprise hooks and engaging pins corresponding thereto, or the connecting means may be adapted to have a positioning function.

According to the invention descirbed above, use of a common lower unit provides different types of copying machines, and when standardized, the lower unit having main components of copying machine can be manufactured in quantities at a reduced cost. Mass production and cost reduction can be achieved alternatively by the combination of a common upper unit and different lower units which are suitably selectable for connnection to the upper unit. Because the upper unit can be accurately positioned on the lower unit by the positioning means when to be connected thereto, the copying machine has another advantage in that the two units can be assembled by a simplified procedure.

What is claimed:

1. A unit-type copying machine comprising:

an upper unit including a document support for holding a document thereon and an optical system for exposing the document to light by scanning, a lower unit formed independently of the upper unit and including a photoconductive drum to be exposed to an image of the document projected thereon from the optical system, a developing device and a transfer device arranged around the drum and a transport assembly for transporting copy paper bearing a developed image transferred thereto from the drum by the transfer device, connecting means provided on the upper unit and the lower unit for detachably connecting the two units together, and positioning means provided for the faces to be joined together of the upper unit and the lower unit for positioning the optical path of projection of the document image from the optical system in the upper unit in coincidence with an exposure station for the drum in the lower unit, said lower unit being usable in common for upper units having different types of optical systems with one of such upper units being suitably selected and connected to the common lower unit.

2. A unit-type copying machine as defined in claim 1 wherein the optical system comprises an exposure lamp for illuminating the document with light, a lens disposed in the optical path of projection of the document image formed by the light reflected from the document, mirrors provided between the lens and the exposure lamp, and a mirror provided between the lens and the drum.

3. A unit-type copying machine as defined in claim 1 wherein one of the upper units has one type of optical system in which the mirrors between the exposure lamp and the lens are movable to give the optical system a life-size copying function, and another one of the upper units has another type of optical system in which the lens and at least one of the mirrors between the exposure lamp and the lens are movable to give the optical system a reduced-scale copying function and an enlarged-scale copying function.

4. A unit-type copying machine as defined in claim 1 wherein the common lower unit has the drum at a predetermined position with respect to the positioning means, and the correlation between the positioning means and members of the optical system other than its lens is determined according to the horizontal distance between the positioning means and the lens of the optial system in the upper unit which distance is predetermined.

5. A unit-type copying machine as defined in claim 1 wherein the correlation between the positioning means and the optical system in the upper unit is determined based on the predetermined position of the drum in the lower unit with respect to the positioning means and on the angle between the incident light on the terminal mirror of the optical system in the upper unit and the reflected light therefrom which angle is predetermined.

6. A unit-type copying machine comprising:

an upper unit including a document support for holding a document thereon and an optical system for exposing the document to light by scanning, a lower unit formed independently of the upper unit and including a photoconductive drum to be exposed to an image of the document projected thereon from the optical system, a developing device and a transfer device arranged around the drum and a transport assembly for transporting copy paper bearing a developed image transferred thereto from the drum by the transfer device, connecting means provided on the upper unit and the lower unit for detachably connecting the two units together, and positioning means provided for the faces to be joined together of the upper unit and the lower unit for positioning the optical path of projection of the document image from the optical system in the upper unit in coincidence with an exposure station for the drum in the lower unit, said upper unit being usable in common for lower units which differ in the diameter of the photoconductive drum or in the type of copy paper transport assembly with one of the lower units being suitably selected and connected to the common upper unit.

7. A unit-type copying machine as defined in claim 6 wherein the position of the drum installed in the lower unit connected to the common upper unit is determined with respect to the positioning means according to the angle between the incident light on the terminal mirror of the optical system in the upper unit and the reflected light therefrom and to the optical axis distance between the terminal mirror and the surface of the drum to be exposed to light.

8. A unit-type copying machine comprising:

an upper unit including a document support for holding a document thereon and an optical system for exposing the document to light by scanning, a lower unit formed independently of the upper unit and including a photoconductive drum to be exposed to an image of the document projected thereon from the optical system, a developing device and a transfer device arranged around the drum and a transport assembly for transporting copy paper bearing a developed image transferred thereto from the drum by the transfer device, connecting means provided on the upper unit and the lower unit for detachably connecting the two units goether, and positioning means provided for the faces to be joined together of the upper unit and the lower unit for positioning the optical path of projection of the document image from the optical system in the upper unit in coincidence with an exposure station for the drum in the lower unit, the optical system comprising an exposure lamp for illuminating the document with light, a lens disposed in the optical path of projection of the document image formed by the light reflected from the document, mirrors provided between the lens and the exposure lamp, and a mirror provided between the lens and the drum, different types of upper or lower units being suitably selectively connectable to the lower or upper unit which is used in common.

* * * * *